US010056209B2

(12) United States Patent
Rodrigues et al.

(10) Patent No.: US 10,056,209 B2
(45) Date of Patent: Aug. 21, 2018

(54) MEDIUM- OR HIGH-VOLTAGE CIRCUIT BREAKER OR ISOLATOR, PROVIDED WITH IMPROVED FIXED CONTACTS, AND METHOD OF USE

(71) Applicant: Alstom Technology Ltd., Baden (CH)

(72) Inventors: Didier Rodrigues, Serpaize (FR); Denis Frigiere, Decines (FR); Jean Marc Willieme, La Mulatiere (FR); Frank Jacquier, Mions (FR); Vincent Royot, Lyons (FR)

(73) Assignee: ALSTOM TECHNOLOGY LTD, Baden (CH)

( * ) Notice: Subject to any disclaimer, the term of this patent is extended or adjusted under 35 U.S.C. 154(b) by 0 days.

(21) Appl. No.: 15/522,427

(22) PCT Filed: Oct. 28, 2015

(86) PCT No.: PCT/EP2015/074976
§ 371 (c)(1),
(2) Date: Apr. 27, 2017

(87) PCT Pub. No.: WO2016/066682
PCT Pub. Date: May 6, 2016

(65) Prior Publication Data

US 2017/0316904 A1 Nov. 2, 2017

(30) Foreign Application Priority Data

Oct. 30, 2014 (FR) ..... 14 60427

(51) Int. Cl.
*H01H 33/12* (2006.01)

(52) U.S. Cl.
CPC ..... *H01H 33/12* (2013.01)

(58) Field of Classification Search
CPC ..... H01H 9/443; H01H 9/46; H01H 1/06; H01H 2033/888; H01H 33/12;
(Continued)

(56) References Cited

U.S. PATENT DOCUMENTS 4,329,552 A 5/1982 McConnell
4,737,607 A * 4/1988 Bernard ..... H01H 33/982 218/23
(Continued)

FOREIGN PATENT DOCUMENTS

DE 19 55 490 U 2/1967
EP 0450104 * 3/1990 ..... H01H 9/32
(Continued)

OTHER PUBLICATIONS

Search Report issued in French Patent Application No. 1460427 dated Jul. 16, 2015.
(Continued)

*Primary Examiner* — Truc Nguyen
(74) *Attorney, Agent, or Firm* — Pearne & Gordon LLP

(57) ABSTRACT

A high- or medium-voltage circuit breaker, in which a movable contact (1) is moved in sliding in order to separate stationary contacts (11, 12) from its sliding surface (2). In accordance with the invention, the stationary contacts (11, 12) have switching portions (9) that separate from the movable contact more or less simultaneously as a result of a setback (19) in the movable contact (1), thereby causing two simultaneous switching arcs to appear (14, 15), which arcs are extinguished much more quickly than a single arc, before the current is transferred to the conventional arcing contacts (5). This disposition enables the stationary contacts (11, 12) and their environment to be less exposed to damage.

1 Claim, 3 Drawing Sheets

(58) Field of Classification Search
CPC .... H01H 33/182; H01H 33/20; H01H 33/664; H01H 33/901; H01H 1/20; H01H 33/08; H01H 73/18; H01H 9/362; H01H 1/2041; H01H 33/42
See application file for complete search history.

(56) References Cited

U.S. PATENT DOCUMENTS 5,844,189 A * 12/1998 Niemeyer ..... H01H 33/7015 218/29
5,977,502 A * 11/1999 Mizoguchi ..... H01H 33/901 218/43
6,100,489 A 8/2000 Zehnder
6,448,519 B1 * 9/2002 Rane ..... H02B 11/04 200/293
6,689,980 B2 * 2/2004 Sohn ..... H01H 33/982 218/43
2011/0315662 A1 * 12/2011 Byron ..... H01H 33/66 218/140
2013/0270228 A1 * 10/2013 Nakada ..... H01H 33/12 218/158
2014/0374382 A1 * 12/2014 Gati ..... H01H 9/56 218/8
2015/0318124 A1 11/2015 Rodrigues
2015/0357135 A1 12/2015 Grejon
2016/0307709 A1 * 10/2016 Ehrlich ..... H01H 33/7061

FOREIGN PATENT DOCUMENTS

FR 2 985 080 A1 6/2013
FR 3 001 575 A1 8/2014

OTHER PUBLICATIONS

International Search Report issued in Application No. PCT/EP2015/074976 dated Dec. 17, 2015.
Written Opinion issued in Application No. PCT/EP2015/074976 dated Dec. 17, 2015.
Utility U.S. Appl. No. 15/532,195, "Electrical Tripout Device Integrating a Circuit Breaker and an Isolator" filed Jun. 1, 2017.

* cited by examiner

MEDIUM- OR HIGH-VOLTAGE CIRCUIT BREAKER OR ISOLATOR, PROVIDED WITH IMPROVED FIXED CONTACTS, AND METHOD OF USE

The present invention provides a medium- or high-voltage switch or circuit breaker, provided with improved stationary contacts, and it also provides a method of using said circuit breaker.

In such switchgear, switching between a closed state and an open state is performed by moving a movable contact along a stroke. The stationary contacts touch a sliding contact surface of the movable contact, and electricity flows from one stationary contact to another through the movable contact, until one of the stationary contacts reaches a break in the sliding surface and loses contact.

It is known that an electric arc is then formed between the movable contact and the isolated stationary contact. This electric arc has damaging effects, in particular by tearing off conductive particles and therefore eroding the contacts between which the arc extends, as well as deteriorating the surrounding atmosphere. That is why other contacts, called arcing contacts, are very frequently associated with the above-described stationary contacts (also called permanent contacts), which arcing contacts touch each other at the beginning of the stroke towards the open state, and separate only after the permanent contacts have already separated. The electric current is then transferred to pass through the arcing contacts while abandoning the permanent contacts; the arc appears between the arcing contacts, at a location in the device that can be selected so as to ensure less damage is suffered; and the arc may then be blasted by a flow of gas that has been compressed in a chamber by the stroke of the movable contact and then released by opening a valve, in known manner.

Although adding arcing contacts is beneficial, it should be stressed that electric arcing between the permanent contacts is not completely eliminated, and there remains a short-lived arc, known as a switching arc, that remains until the current passes only via the arcing contacts. Said switching arc may also damage the switchgear because of its high temperature, which is capable of rising to a few hundred or a few thousand degrees, thereby producing local melting and erosion of the contact material, and also spraying particles into the surroundings. This results in the dielectric strength of the switchgear being weakened via the solid elements or the surrounding gas, and leads to a risk of breakdowns and sparkovers or flashovers. That is why the French patent application published under number 3 001 575 envisages constructing the movable contact in two portions separated by insulation, and constructing one of the stationary contacts as a main portion and an auxiliary portion. The current flows through the main portion of the stationary contact during normal service, but the switching arc extends starting from the auxiliary portion. The advantage of that device is that the location at which the switching arc appears may be sufficiently isolated for the arc to cause less damage, but without reducing the arc itself.

It is also possible to consider applying arc-blasting techniques to switching arcs, but that is not always convenient, nor is it permitted in all kinds of switchgear; and the use of a dielectric arc-quenching gas, involving the switchgear being hermetically sealed, is thus often necessary.

The invention proceeds from another idea: weakening the switching arc, and its effects, by splitting it into two, and causing it to appear simultaneously or almost simultaneously at both of the stationary contacts.

In general form, the invention provides switching or circuit breaking switchgear, including a movable contact provided with a switching stroke switching from a closed state to an open state of the switchgear and with a sliding surface, a first stationary contact and a second stationary contact touching the sliding surface, a first break in the sliding surface being crossed by the first stationary contact during the switching stroke; the switchgear being characterized in that the sliding surface has a second break that is crossed by the second stationary contact during the switching stroke, at essentially the same time as the first break is crossed by the first stationary contact.

In other words, the stationary contacts cross the breaks of the sliding surface together, i.e. at the same time, or with a small time lag chosen to make it possible for the switchgear to interrupt the current where, as a function of a suitable speed of the movable contact during the stroke from the closed state to the open state, simultaneous switching arcs are struck between the switching portions and the breaks in the sliding surface of the movable contact.

This sharing of the switching arc between both stationary contacts promotes fast extinction, and thus reduces the amount of heat that the arc produces and the amount of damage to the permanent contacts. This is particularly visible in a particularly preferred embodiment of the invention, where each stationary contact includes a main portion and a switching portion, the main portion and the switching portion being electrically connected, both touching the sliding surface, but being arranged in such a manner that electricity passes preferentially via the main portion between the stationary contact and the movable contact; and where, for each stationary contact, the main portion reaches the break in the sliding surface before the switching portion. Again in this example, the condition to be satisfied is that the stationary contacts disconnect together, simultaneously or almost simultaneously, from the movable contact by crossing a setback therein.

The invention is described in detail below in connection with the following figures, in which.

Figure 7:
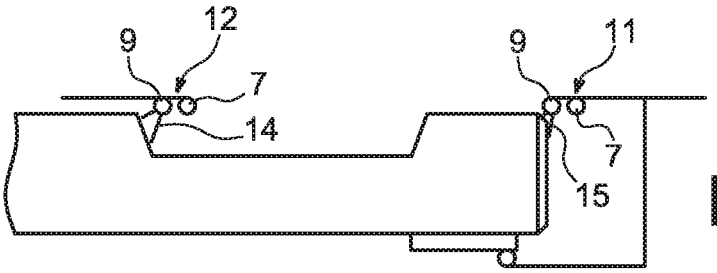
Figure 8:
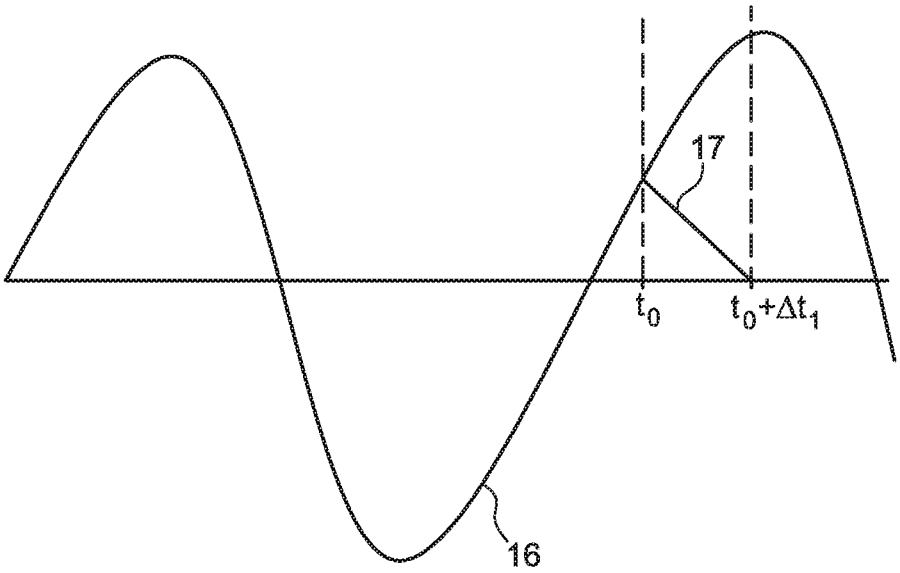
Figure 9:
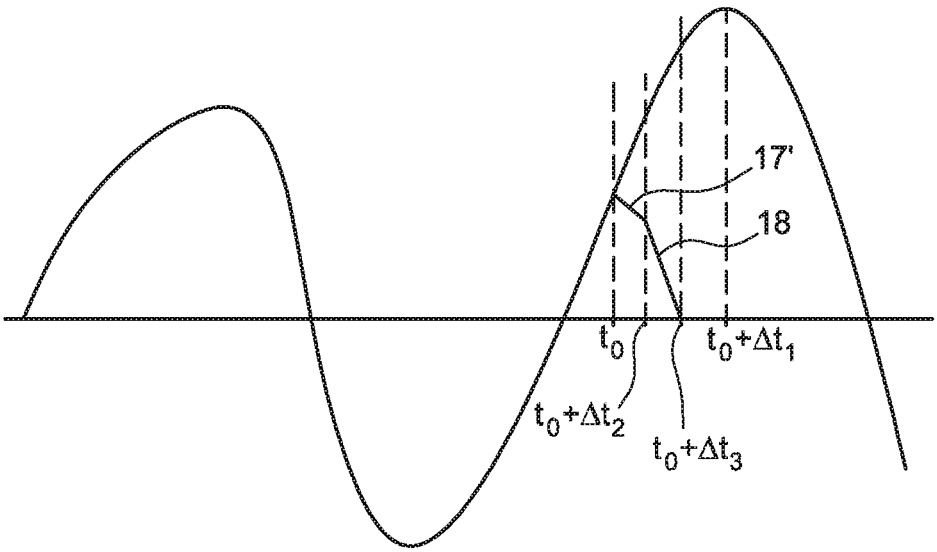

FIGS. 3, 4, 5, 6, and 7 explain in detail the switching steps, from closing to opening, of one embodiment of the invention; and FIGS. 8 and 9 show how the extinction of the switching arc takes place.

Figure 1:
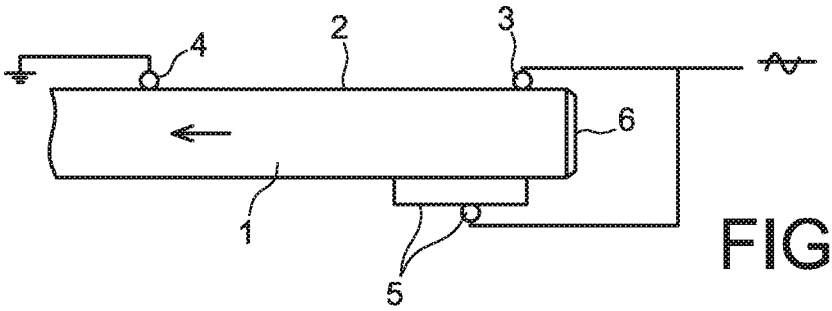
FIG. 1 is a view of a high- or medium-voltage circuit breaker of the prior art.

FIG. 1 is a diagram showing a circuit breaker of the prior art, where a movable contact 1, in the form of a tube, slides to the left, under the action of a control mechanism, in order to open the circuit breaker. It includes sliding surfaces that touch two stationary contacts 3 and 4 (via the same sliding surface 2 in this example, but that is not necessary). The circuit breaker is also provided with mutually sliding arcing contacts 5 that are electrically connected respectively to the movable contact 1 and to the first stationary contact 3. The sliding surface 2 stops at one end 6 of the movable contact 1. When the electric circuit controlled by the circuit breaker opens, the first stationary contact 3 is released from the movable contact 1, and a switching arc briefly appears between them, until current flow is established via the arcing contacts 5. Said contacts also separate after an additional stroke of the movable contact 1, which truly opens the circuit breaker, while at the same time creating an arc between the arcing contacts 5, which arc is extinguished conventionally by blasting.

Figure 2:
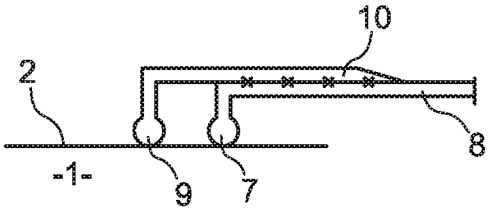
FIG. 2 shows permanent stationary contacts for use in the invention.

The stationary contacts of the invention may have the appearance shown in FIG. 2. Each of them includes a main portion 7, connected directly to an electricity transmission line 8, and a switching portion 9, which is an auxiliary portion that is also connected to said line 8, but in a way in which it is more difficult for current to pass. The switching portion 9 may thus be welded to the line 8 via an endpiece 10 and it may be made of a material that is less good at conducting electricity than the main portion 7. The portions 7 and 9 are designed so that both of them touch the sliding surface 2 together when the circuit breaker is closed, but at a short distance apart. The invention could be implemented with single-portion stationary contacts such as the contacts 3 and 4 shown in FIG. 1, perhaps with less effectiveness.

Figure 3:
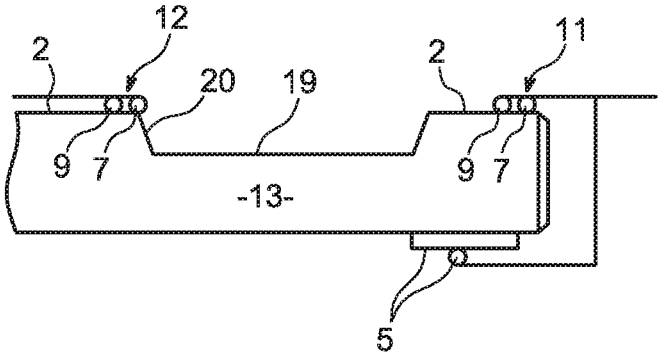
Figure 4:
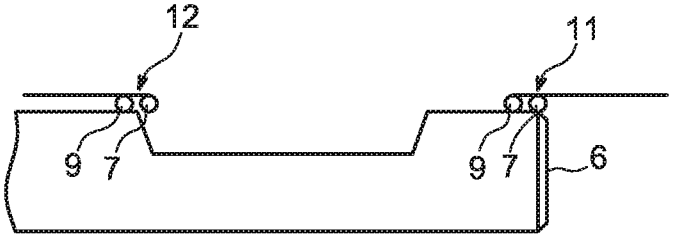
Figure 5:
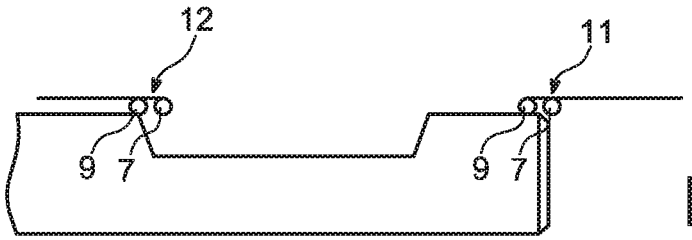
Figure 6:
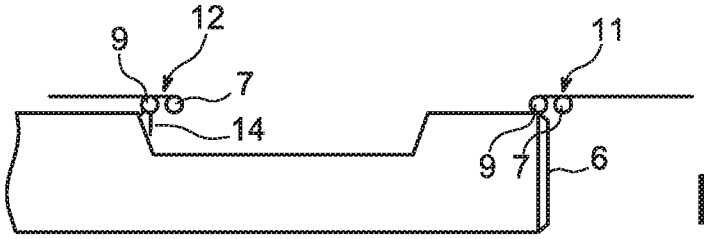

Reference is made to FIG. 3, which shows an embodiment of the invention in which the stationary contacts 3 and 4 have been replaced by stationary contacts 11 and 12 constructed in accordance with FIG. 2. The switching state that is shown is quite close to the opening, with the main portion 7 of the first stationary contact 11 being located not far from the end 6, and with the switching portion 9 being a little farther away. The movable contact, now referenced 13, includes an intermediate setback 19 having an end face 20 that constitutes another break in the sliding track 2, and the main portion 7 of the second stationary contact 12 is close to the setback.

While the circuit breaker continues its opening stroke, this arrangement results in the portions 7 and 9 of the stationary contacts 11 and 12 separating from the sliding surface 2, by crossing either the end 6, or the end face 20 of the intermediate setback 19. The order of separation could be as described below.

The first portion to separate is the main portion 7 of the second stationary contact 12 (FIG. 4); then the main portion 7 of the first stationary contact 11 (FIG. 5); then the switching portion 9 of the second stationary contact 12 (FIG. 6); and finally the switching portion 9 of the first stationary contact 11 (FIG. 7). However, some variants of operation can be accepted. Thus, the main portions 7 can separate in unspecified order, and the switching portions 9 can also separate in unspecified order; they can also separate simultaneously; and the states shown in FIGS. 5 and 6 could occur in reverse order.

On separation of the portions 7 and 9 of the contacts 11 and 12, current passes via the switching portions 9 when the main portions 7 separate from the movable contact 1, and switching arcs 14 and 15 appear when the switching portions 9 separate from the movable contact 1. In accordance with the invention, the switching arcs 14 and 15 exist simultaneously for an instant, as shown in FIG. 7, for reasons that are explained below with reference to the last figures. That is due to the simultaneous or almost simultaneous separation of the stationary contacts 11 and 12 that cross the end 6 and the end face 20 at a time interval that is advantageously shorter than one half-period of alternating current, by means of the movable contact 1 being moved at a suitable speed.

The curve 16 of FIG. 8 shows the current produced at the terminals of the circuit breaker. When the FIG. 6 state is reached at an instant $t_0$, if there were no second arc 15, the switching arc 14 would be of magnitude that decreases in substantially linear manner along the segment 17 and that stops at the instant $t+\Delta t_1$, the current then being then taken up by the arcing contacts 5. But if, in accordance with the invention, the other switching arc 15 starts at $t_0$ or starts immediately after, at the instant $t_0+\Delta t_2$ (FIG. 9), segment 17, now given reference 17', is interrupted and it can be seen that the simultaneous arcs 14 and 15 then weaken much faster, along the following segment 18, so that they are extinguished at the instant $t_0+\Delta t_3$, where $\Delta t_3$ is less than $\Delta t_1$. The duration and the average magnitude of the arcs, as well as the damage inflicted on the contacts, are then significantly reduced. The same advantages remain present with the above-mentioned operating alternatives, and also for single-portion contacts, such as the conventional stationary contacts 3 and 4.

The invention claimed is:

1. Switching or circuit breaking switchgear, including a movable contact (13) provided with a switching stroke switching from a closed state to an open state of the switchgear and with a sliding surface (2), a first stationary contact (11) and a second stationary contact (12) touching the sliding surface; a first break (6) in the sliding surface, being crossed by the first stationary contact (11) during the switching stroke; wherein the sliding surface has a second break (20) that is crossed by the second stationary contact (12) during the switching stroke, at essentially the same time as the first break is crossed by the first stationary contact, wherein each of the stationary contacts includes a main portion (7) and a switching portion (9), the main portion and the switching portion being electrically connected, both touching the sliding surface (2), but being arranged in such a manner that electricity passes preferentially via the main portion between the stationary contact and the movable contact and wherein, for each stationary contact, the main portion reaches the break in the sliding surface before the switching portion.

* * * * *